US005676098A

United States Patent [19]

Cecur

[11] Patent Number: 5,676,098

[45] Date of Patent: Oct. 14, 1997

[54] MECHANICAL DIRECT-ACTING TAPPET WITH ROLLER FOLLOWER

[75] Inventor: Majo Cecur, Rivarolo Canavese, Italy

[73] Assignee: Eaton Corporation, Cleveland, Ohio

[21] Appl. No.: 720,986

[22] Filed: Oct. 15, 1996

[30] Foreign Application Priority Data

Oct. 27, 1995 [IT] Italy ..... MI95A2219

[51] Int. Cl.[6] ..... F01L 1/14; F01L 1/20

[52] U.S. Cl. ..... 123/90.5; 123/90.33; 123/90.52

[58] Field of Search ..... 123/90.48, 90.5, 123/90.33, 90.35, 90.51, 90.52; 74/569

[56] References Cited

U.S. PATENT DOCUMENTS

| | | | |
|---|---|---|---|
| 5,186,130 | 2/1993 | Melchior | 123/90.35 |
| 5,327,860 | 7/1994 | Kruger | 123/90.48 |
| 5,343,833 | 9/1994 | Shirai | 123/90.48 |
| 5,365,897 | 11/1994 | Speil et al. | 123/90.55 |
| 5,553,512 | 9/1996 | Harimoto | 123/90.55 |
| 5,566,652 | 10/1996 | Deppe | 123/90.35 |

*Primary Examiner*—Weilun Lo
*Attorney, Agent, or Firm*—L. J. Kasper

[57] ABSTRACT

A mechanical direct-acting bucket-type tappet which includes a sheet metal body, a plastic block within the body and having a cam-contacting roller received therein, a metal disc received within a seat formed in the block and operable to contact an engine valve, and opposed fins formed on the body in straddling relation to the roller and extending above the cam contacting surface of the roller such that they are in straddling relation to the engine cam.

6 Claims, 3 Drawing Sheets

MECHANICAL DIRECT-ACTING TAPPET WITH ROLLER FOLLOWER

The present invention relates to a mechanical direct-acting tappet for an internal combustion engine provided with a roller cam follower.

Mechanical direct-acting tappets, conventionally comprise a body having a substantially flat top surface which is operated by one of the cams of the camshaft of an engine. The downwardly directed thrust applied to the tappet is thus directly transferred to the valve stem which his biased open by a spring.

In prior tappets of this type, there is sliding contact between the cam lobe and the tappet surface and the consequent friction wears the surface so that it is necessary to choose the material of the plate forming the top surface of the tappet accordingly, and to grind the said plate surface to a high degree of accuracy. Moreover, the sliding friction also causes an energy loss which reduces the efficiency of the engine.

An object of the present invention is to reduce wear on the tappet and the mentioned energy loss, thereby increasing the life of the tappet and cams as well as the engine efficiency.

According to the present invention, a cam-contacting roller is provided in the body of the tappet, the axis of the roller being parallel to the rotation axis of the camshaft. The roller is retained in a plastic block which surrounds the roller for an extent more than half of its periphery in order to hold the roller in its seat while allowing it to rotate. The opposite vertical end walls of the plastic block are cylindrical and are fitted in two opposite vertical wall sections provided at the top of a cylindrical metal tube forming the body of the tappet, the bottom portion thereof surrounding the stem of the respective valve to be operated.

In order to maintain the rotational axis of the roller parallel to the rotational axis of the camshaft, the ends of the roller are held in a fixed position by two upwardly projecting fins, integral with the body of the tappet, which maintain the alignment of the camshaft axis with the rotational axis of the roller.

A disc-like shim element having an adjustable thickness is inserted in the bottom portion of the plastic block to contact the top end portion of the valve stem.

Other objects are advantages of the invention will be apparent from the following description when considered in connection with the accompanying drawings, wherein.

Figure 1:
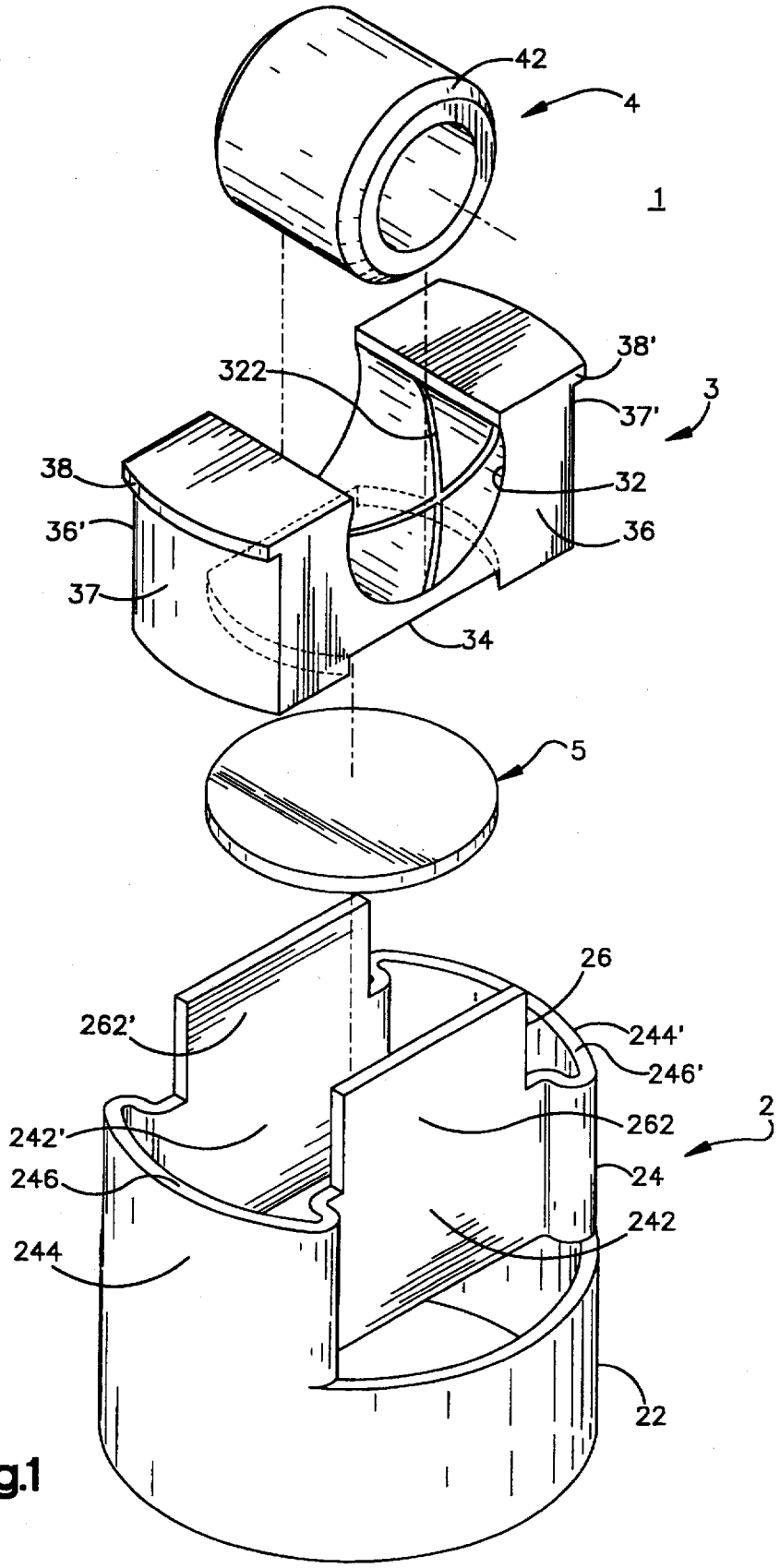
FIG. 1 is an exploded view illustrating the component parts of the mechanical direct-acting tappet according to the present invention.
Figure 2:
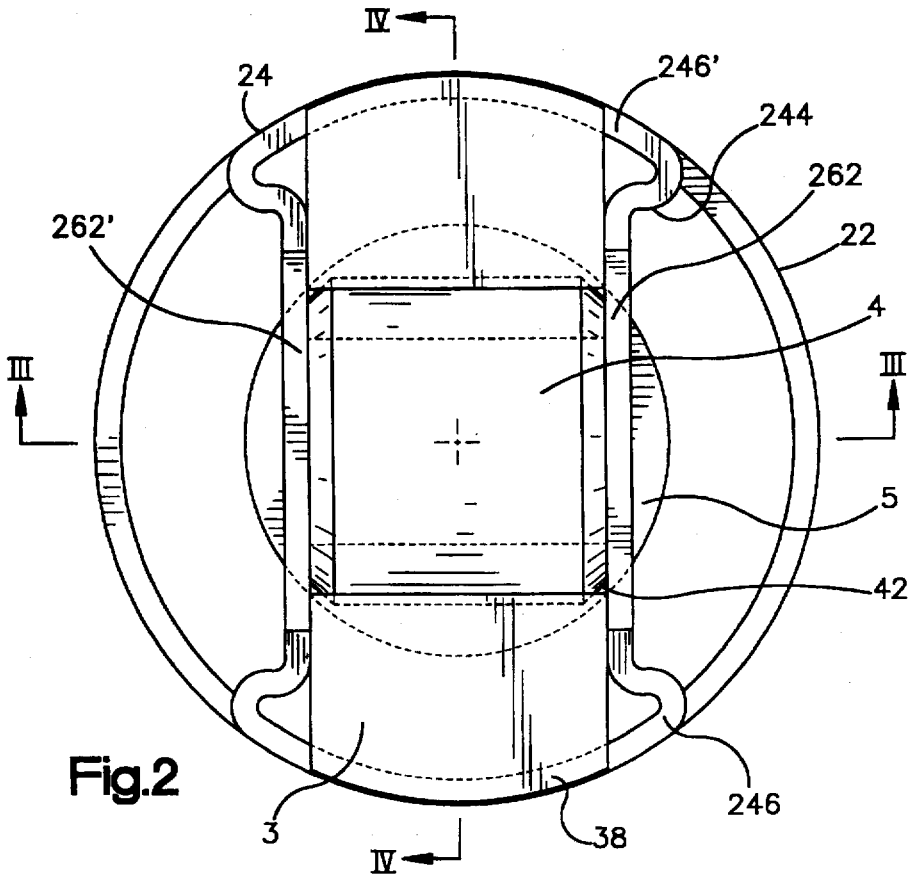
FIG. 2 is a plan view of the tappet shown in FIG. 1.

As shown in FIG. 1, the mechanical direct-acting tappet, which is generally indicated under the reference number 1, comprises a hollow body 2 including a bottom portion 22, a middle portion 24 and a top portion 26 integral with one another, preferably formed from a single metal tube by means of punching and shearing operations; a plastic block 3, having a cylindrical bearing surface 32 and a recessed seat 34 formed therein, a hollow, hardened steel roller 4 which is received within the bearing surface 32; and a disc element 5 received in the seat 34. As will be described in further detail below, discs 5 of varying thicknesses can be provided.

The bottom portion 22 of the hollow body 2 is of cylindrical tubular shape and is slidingly received in a bore (not shown) formed in the engine head in coaxial relation to a valve stem (not shown).

The middle portion 24 comprises two flat opposite vertical walls 242, 242', recessed with respect to the circumference of the bottom tubular portion 22, and two walls 244, 244' perpendicular to the walls 242, 242' and having a curved shape as an extension of the bottom portion 22. Each curved wall 244, 244' is cut at the top thereof so as to provide abutment surfaces 246, 246' and, in the areas where they meet with the walls 242, 242' are bent toward the inside of the body 2 to connect with vertical flat fins 262, 262' forming the top portion 26 of the body 2, said fins 262, 262', which are defined by extensions of the flat vertical walls 242, 242', being in position to hold the end portions of the roller 3 and for preventing the tappet from rotating and thus holding the axis of the roller parallel to the axis of the camshaft.

The block 3, of a suitable plastic material, is provided with two flat opposite walls 36, 36' and two further walls 37, 37', perpendicular to said walls 36, 36', having a curved configuration and shaped and sized so as to allow the block 3 to be received inside the middle portion 24 of the body 2 of the tappet between the flat walls 244, 244' of the middle portion 24 of the body. The cylindrical bearing surface 32 extends so as to surround more than half of the circumference of the roller 4 received in the bearing surface to retain the roller within the block in contact with the bearing surface. In order to facilitate the lubrication of the roller, lubrication slots or grooves 322 am formed in the surface 32.

Projecting shoulders 38, 38' are formed extending from the curved walls 37, 37' of the block 3 and bear on the abutment surfaces 246, 246' of the middle portion 24 to locate the block 3 inside the body 2.

On the bottom surface of the block 3 the disc element 5, is press fit within the seat 34 in position to contact the valve stem. Discs of varying thicknesses can be provided to obtain an optimum lash setting between the tappet and the valve.

The roller 4 is made of a hardened steel and is hollow preferably in order to reduce its weight. The roller has an outer diameter sized in relation with the diameter of the cylindrical bearing surface 32 such that the roller rotates freely within the bearing surface and is preferably provided, at its ends, with beveled portions 42 which facilitate the inflow of lubricating oil between the outer surface of the roller and the bearing surface 32.

Figure 3:
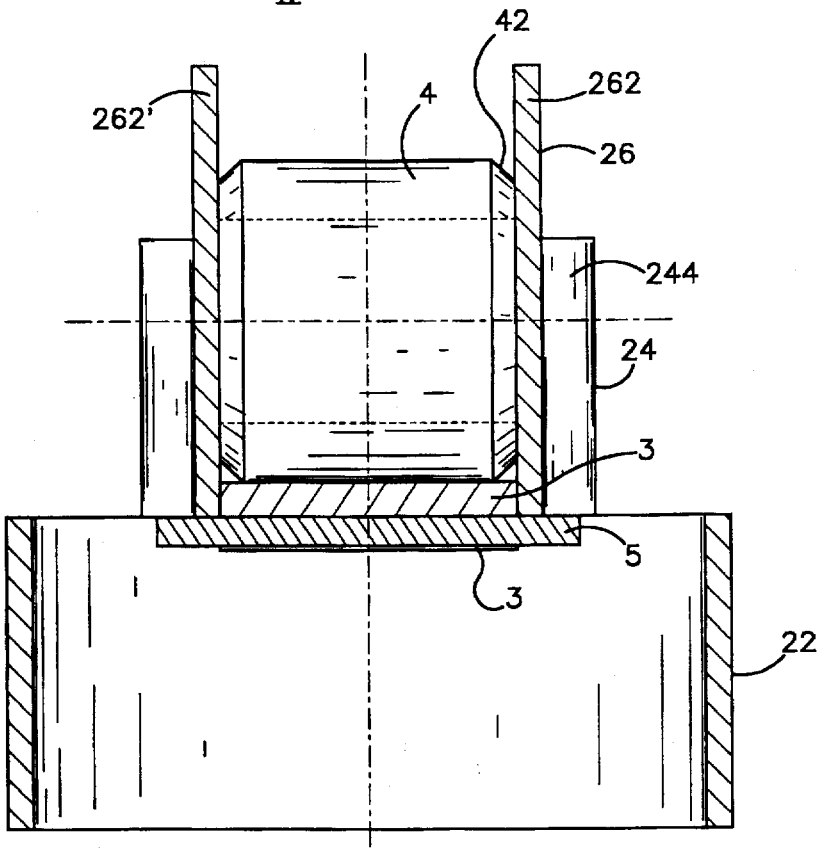
FIG. 3 is a cross-sectional view of the tappet taken along line III & III of FIG. 2.
Figure 4:
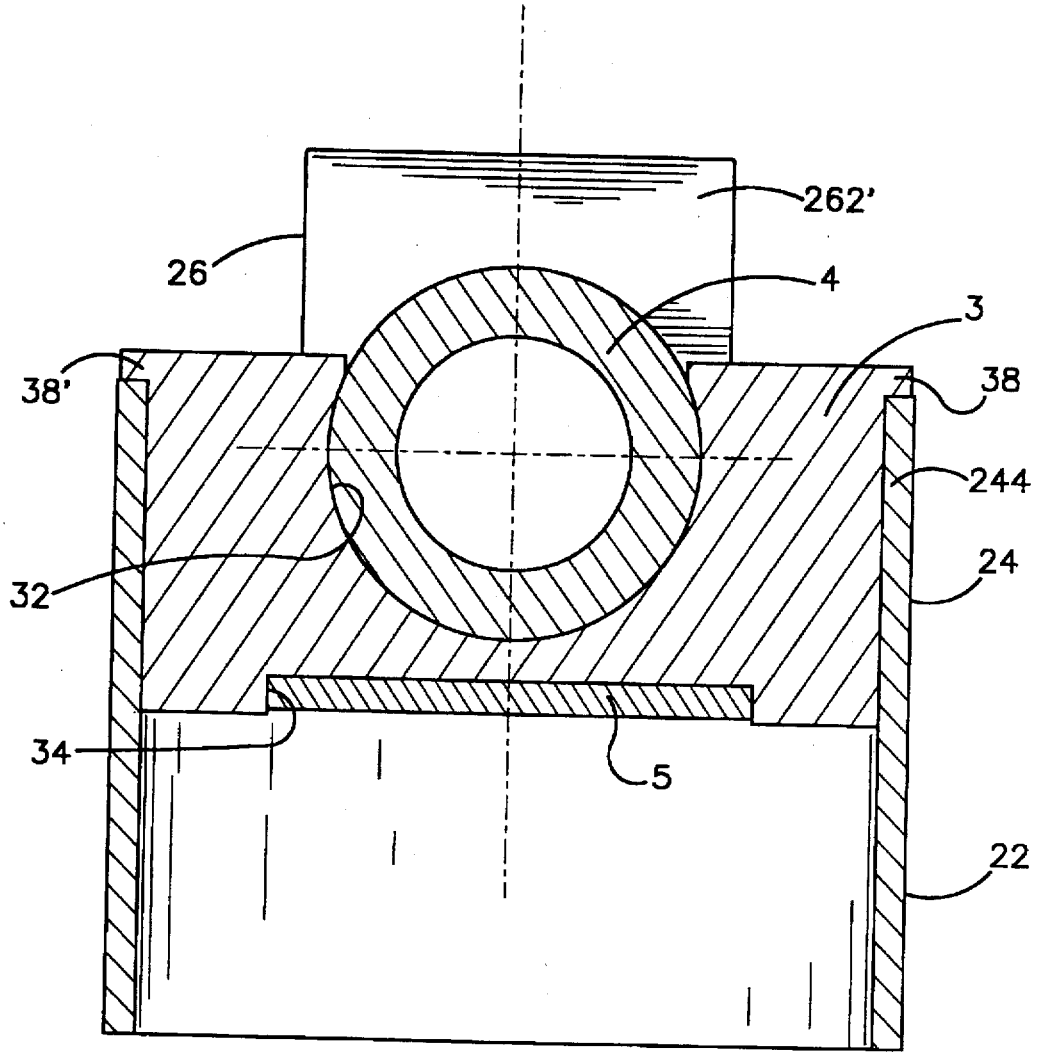
FIG. 4 is a cross-sectional view of the tappet taken along line IV-IV of FIG. 2.

In operation, when the tappet is on base circle with respect to the cam a predetermined clearance or lash is set between the cam and the roller by selecting a disc 5 having the thickness required to obtain that clearance. Upon turning the camshaft, the cam will progressively engage the roller to open the valve. The parallel relationship of the rotation axis of the roller and the rotation axis of the camshaft is always assured by the restraining fins 262, 262', which as best seen in FIGS. 3 and 4 are in position to straddle the cam.

I claim:

1. A mechanical direct-acting tappet, characterized in that said tappet consists of:

a ho)low body made of a pressed metal sheet material;

a block received within said body and having a cylindrical bearing surface formed in a top surface thereof and a flat seat surface formed in the bottom thereof;

a roller operable to engage an engine cam received within said cylindrical bearing surface; and a metal disc element, received in said flat seat surface and operable to engage an engine valve.

2. A mechanical tappet according to claim 1, characterized in that said roller is tubular.

3. A mechanical tappet according to claim 1, characterized in that said cylindrical bearing surface is provided with slots permitting the flow of lubricating oil to said bearing surface.

4. A mechanical tappet according to any one of claims 1, 2 or 3 characterized in that said cylindrical bearing surface surrounds more than half of the periphery of said roller.

5. A mechanical tappet according to claim 4, characterized in that said tappet body comprises a cylindrical tubular bottom portion; a middle portion defined by two opposite fiat vertical walls recessed with respect to the circumference of the bottom tubular portion, and two curved walls perpendicular to said vertical flat walls and defining an extension of the tubular surface of the bottom portion, and a top portion comprising two vertical fins defined by an extension of said vertical fiat walls of said middle portion, said fins being engageable with the side walls of said roller and extending upward beyond the cam engaging surface of said roller.

6. A mechanical tappet according to claim 5, characterized in that said block includes opposed flat vertical walls received between the flat vertical walls of said middle portion.

* * * * *